US008469548B2

(12) United States Patent
Qiu

(10) Patent No.: US 8,469,548 B2
(45) Date of Patent: Jun. 25, 2013

(54) FLASH LIGHT WITH ADJUSTABLE LIGHT ARRANGEMENT

(75) Inventor: Fu jun Qiu, Ningbo (CN)

(73) Assignee: Ningbo Futai Electric Co., Ltd., Ningbo, Zhejiang (CN)

( * ) Notice: Subject to any disclaimer, the term of this patent is extended or adjusted under 35 U.S.C. 154(b) by 387 days.

(21) Appl. No.: 12/802,543

(22) Filed: Jun. 8, 2010

(65) Prior Publication Data

US 2011/0063824 A1 Mar. 17, 2011

Related U.S. Application Data

(63) Continuation-in-part of application No. 12/586,132, filed on Sep. 16, 2009.

(51) Int. Cl.
*F21V 7/00* (2006.01)

(52) U.S. Cl.
USPC ..... 362/308; 362/188

(58) Field of Classification Search
USPC ..... 362/188, 308, 263–265
See application file for complete search history.

(56) References Cited

U.S. PATENT DOCUMENTS

| | | | | |
|---|---|---|---|---|
| 1,674,650 | A * | 6/1928 | Leser | 362/188 |
| 5,036,444 | A * | 7/1991 | Hiles | 362/188 |
| 7,083,299 | B2 * | 8/2006 | Chapman | 362/188 |
| 2011/0063823 | A1 * | 3/2011 | Qiu | 362/188 |

* cited by examiner

*Primary Examiner* — Mary Ellen Bowman
(74) *Attorney, Agent, or Firm* — Raymond Y. Chan; David and Raymond Patent Firm

(57) ABSTRACT

A flash light includes a housing having a front end and a rear end to define a fixed length from the front to rear end. The housing further has a light cavity and a power cavity for receiving power source. The light arrangement includes a lens disposed at the front end of the housing, a light source disposed within the light cavity, and a light adjustor movably coupling with the housing to selectively adjust a distance between the lens and the light source along a longitudinal axis direction of the housing for adjusting the illumination angles of the light beam without altering the fixed length of the housing. The flash light is adapted for selectively adjusting illumination angles to provide variety of light patterns.

18 Claims, 7 Drawing Sheets

FLASH LIGHT WITH ADJUSTABLE LIGHT ARRANGEMENT

CROSS REFERENCE OF RELATED APPLICATION

This is a CIP application that claims the benefit of priority under 35 U.S.C. §119 to a non-provisional application, application Ser. No. 12/586,132, filed Sep. 16, 2009.

BACKGROUND OF THE PRESENT INVENTION

1. Field of Invention

The present invention relates to a flash light apparatus, and more particularly to a flash light apparatus with adjustable light arrangement, which is able to selectively adjust the focus of a light source emitting from a lens of the flash light apparatus with a fixed length of the housing.

2. Description of Related Arts

Flash light is commonly used in many emergency situations or dark environments. It is portable and can be used in many different places for many reasons. For examples, when the police man is on duty at night and passing through a sparsely populated area, he/she needs temporarily illuminate the area for searching; when people go camping or hiking, the flash light device is one of the indispensable equipments to assist them find a way out under the weak or dark light.

Traditionally, the flash light has a fix light intensity and specific pattern, so that the user has to choose one flash light for one purpose, such as the flash light which is able to gather the light for focus on a relatively smaller area for higher light intensity. The user may choose another flash light which is able to illuminate a longer distance and wider range of the environment. It is inconvenient if the flash light has only one illuminating pattern. For instance, a hiker carrying the fixed light pattern flash light can not efficiently adjust the flash light to focus on the near sight object to prevent being tripped by the object, or adjust the flash light to illuminate the far sight to check out the environment for safety purpose.

Therefore, in order to meet the requirement for using the flash light in variety situations, an adjustably focus between the lens and the light source of the flash light is invented for providing a plurality of light pattern, so that the flash light is able to selectively illuminate both of the near and far sight, or choose light emitting angle projected through the lens of the flash light. The most common flash light with selectively adjustable light pattern is through adjusting the position of the lens in responsive to the fixed location of the light source, so as to provide a variety of focus. The light patterns of the flash light are generated in responsive to the distances between the lens and the light source. Thus, the distance between the lens and the light source are normally adjusted via rotating a front end portion of the flash light to rotatably move the lens away from or closer to the light source, so as to generate the variety of light patterns.

However, the overall length of the flash light is longer after the lens at the front end portion of the flash light is rotatably moved away from the light source, so that the flash light may not be able to fit into the original pocket or compartment for storing the flash light, such as packing up the flash light into the compartment of a gun set worn by the policemen. In order to store the flash light into the bag or compartment and minimize the overall size of the flash light, the front end portion of the flash light usually has to be rotated to a minimized distance between the lens and the light source, so that the flash light can be stored. When the user, such as hiker, policemen, or solider takes out the flash light for illumination, the user has to rotatably re-adjust the focus of the lens and the light source to a predetermined distance, so as to select the light pattern the user desired or needed.

SUMMARY OF THE PRESENT INVENTION

The invention is advantageous in that it provides a flash light with adjustable light arrangement for providing a plurality of illumination angles. Meanwhile, the total length of the flash light housing is remaining the same.

Another advantage of the invention is to a flash light with adjustable light arrangement, wherein the adjustor is able to selective adjust a distance between the light source and the lens without altering the fixed length of the housing.

Another advantage of the invention is to provide a flash light with adjustable light arrangement, wherein the illumination angle of the light beam can be selectively adjusted via adjusting the focus of the lens and the light source through reciprocatingly moving the light source toward or away from the lens, so as to minimize the overall length of the flash light.

Another advantage of the invention is to provide a flash light with adjustable light arrangement, wherein the lens is a convex lens, so that the light beam projected from the light source through the lens is able to have a maximized projecting angle.

Another advantage of the invention is to provide a flash light with adjustable light arrangement, wherein the driven part of the light supporter are engaging with the actuator for being pushed thereby to move frontwardly and backwardly to adjust the adjustable distance between the light source and the lens.

Another advantage of the invention is to provide a flash light with adjustable light arrangement, wherein the actuator is able to be pushed frontwardly and backwardly to drive the light supporter, so as to provide a one hand operable actuator for adjusting the illumination angle of the light source.

Another advantage of the invention is to provide a flash light with adjustable light arrangement, wherein the actuator is engaging with the driven part of the light supporter via meshing the gear teeth with the cut teeth of the actuator and the light supporter respectively, so as to efficiently apply a rotatably pushing force at the actuator to drive the light supporter reciprocatingly moving along the longitudinal axis of housing.

Another advantage of the invention is to provide a flash light with adjustable light arrangement, wherein the cut teeth and the gear teeth are spacedly and parallelly extended at the driven part and the circumferential surface of the actuator respectively, so as to minimize the pushing force while minimize the adjustable distance.

Another advantage of the invention is to provide a flash light with adjustable light arrangement, wherein the conductive holder and tubular conductor effectively ensure the light source electrically contacting with the power source when the light source is being reciprocatingly moved toward or away from the light source.

Another advantage of the invention is to provide a flash light with adjustable light arrangement, wherein the lens is affixed at the front end portion of the flash light, so that the lens can be able to completely seal the housing of the flash light apparatus, so as to provide the water proof and dust proof function.

Additional advantages and features of the invention will become apparent from the description which follows, and may be realized by means of the instrumentalities and combinations particular point out in the appended claims.

According to the present invention, the foregoing and other objects and advantages are attained by a flash light apparatus with adjustable LED arrangement, comprising a hollow housing and a light arrangement.

The hollow housing has a front end and a rear end to define a fixed length from the front end to the rear end, a light cavity formed within the front end, and a power cavity formed within the rear end for receiving a power source within the power cavity.

The light arrangement comprises:

a lens coaxially supported at the front end of the housing, a light source being disposed within the light cavity for generating a light beam alignedly toward the lens, and an adjustor movably coupling with the housing to selectively adjust a distance between the lens and the light source along a longitudinal axis direction of the housing, so as to selectively adjust an illumination angle of the light beam without altering the fixed length of the housing.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
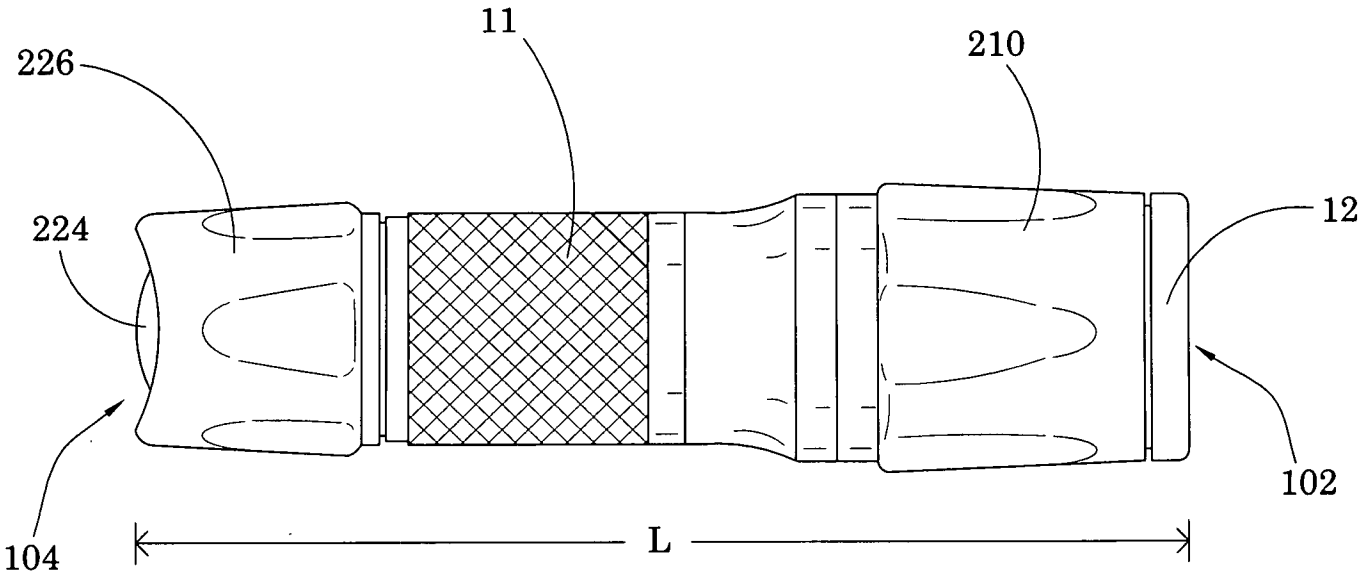
FIG. 1 is a side view of a flash light apparatus according to a preferred embodiment of the present invention.
Figure 2:
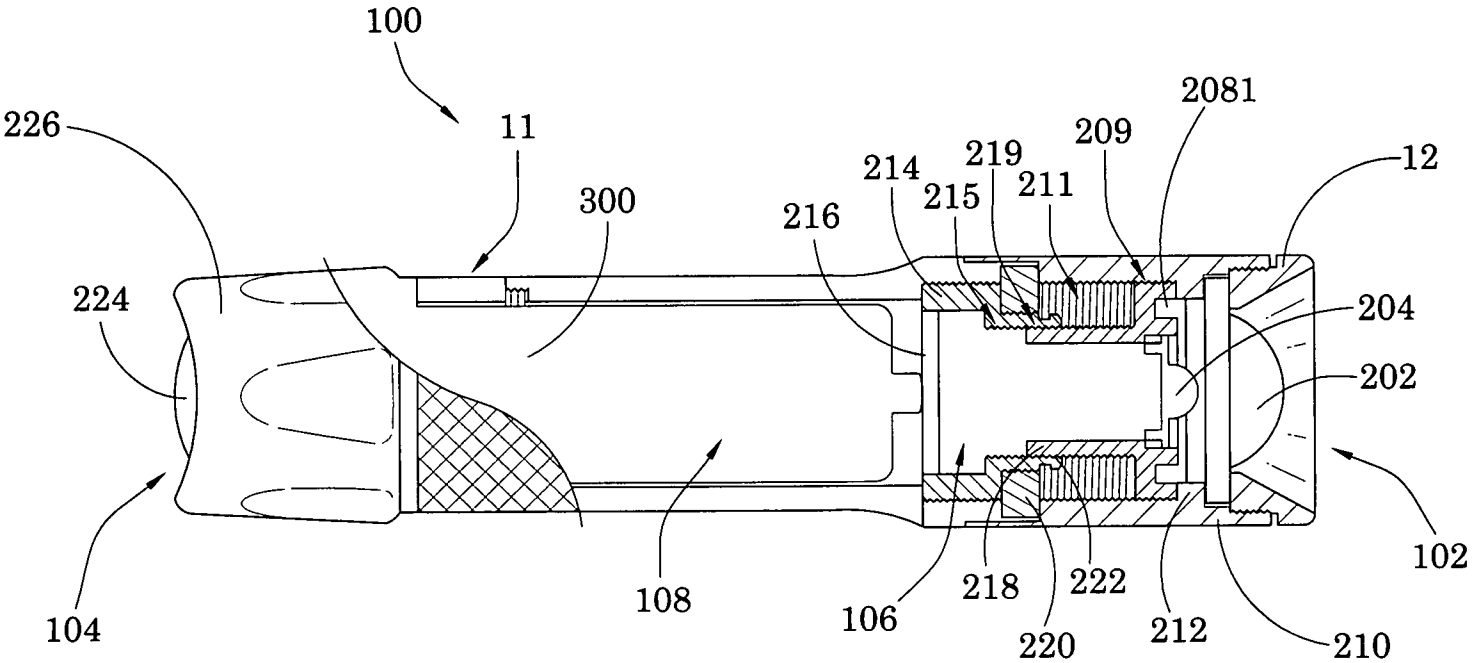
FIG. 2 is a side sectional view of the flash light apparatus according to the preferred embodiment of the present invention.

Referring to FIGS. 1 and 2 of the drawings, a flash light according to a preferred embodiment of the present invention is illustrated, wherein the flash light comprises a hollow housing 100 and a light arrangement 200.

The housing 100 has an open front end 102 and a closed rear end 104 to define a fixed length L between the front end 102 and the rear end 104. The housing 100 further has a light cavity 106 formed at the front end 102 of the housing 100 and a power cavity 108 formed at the rear end 104 for receiving a power source 300, which is electrically linked to the light arrangement 200.

The light arrangement 200 comprises a lens 202, a light source 204 disposed within the light cavity 106, and a light adjustor 206. The lens 202 is coaxially supported at the front end 102 of the housing 100. The light source 204, preferably a LED, is disposed within the light cavity 106 within the light cavity 106 of the housing 100 for generating a light beam alignedly toward the lens 202. The light adjustor 206 is movably coupling with the housing 100 to selectively adjust a distance between the light source 204 and the lens 202 along a longitudinal axis of the housing 100 for adjusting an illumination angle of the light beam without altering the fixed length L of the housing 100.

According to the preferred embodiment, the lens 202 of the light arrangement is preferably a resin convex lens to seal and affix at the front end 102 of the housing 100, such that the convex lens 202 is able to provide a relatively wider range of the illumination angle to illuminate a larger area when the distance between the lens 202 and the light source 204 is minimized. The lens 202 may be made by the resin material to form a durable optical resin lens 202 with high light transmitting property. It is worth to mention that the light source 204 is preferably LED due to the benefit of high intensity and low power requirement thereof. The light source 204 may also be a traditional light bulb or any other light sources which can be applied on the flash light.

Figure 3:
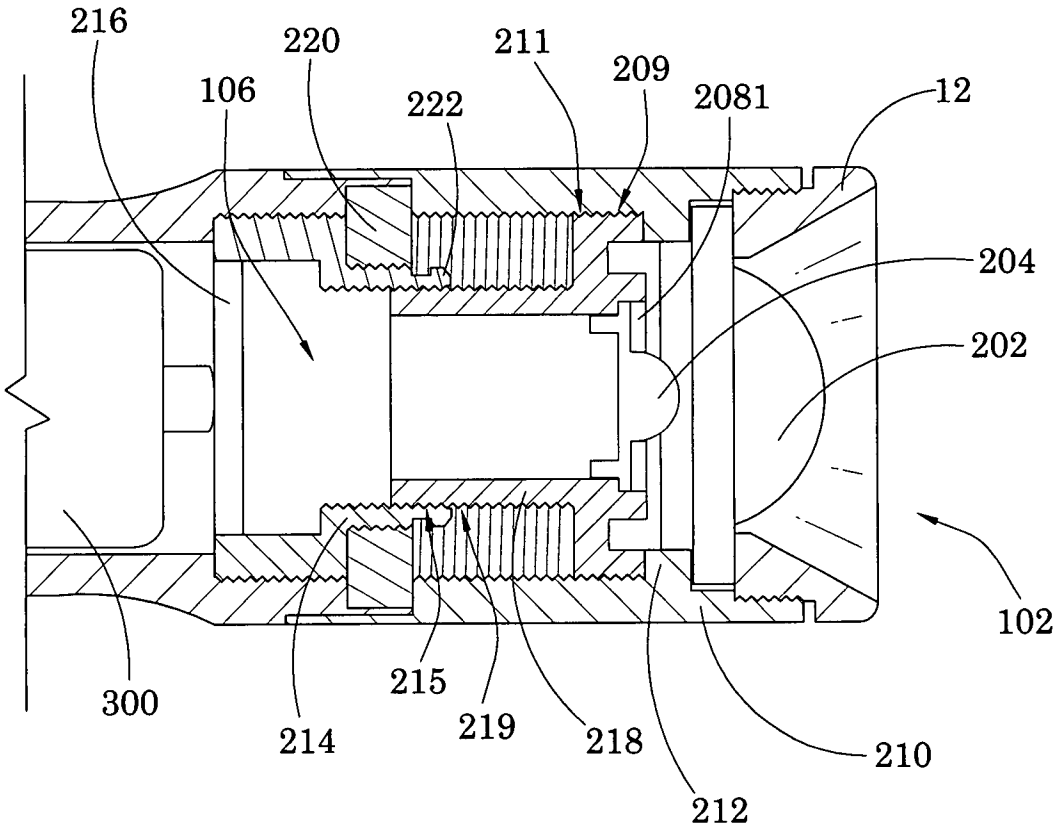
FIG. 3 is a partially sectional view of the flash light apparatus according to the preferred embodiment of the present invention, illustrating the light source being moved at a forward position close to the lens.
Figure 4:
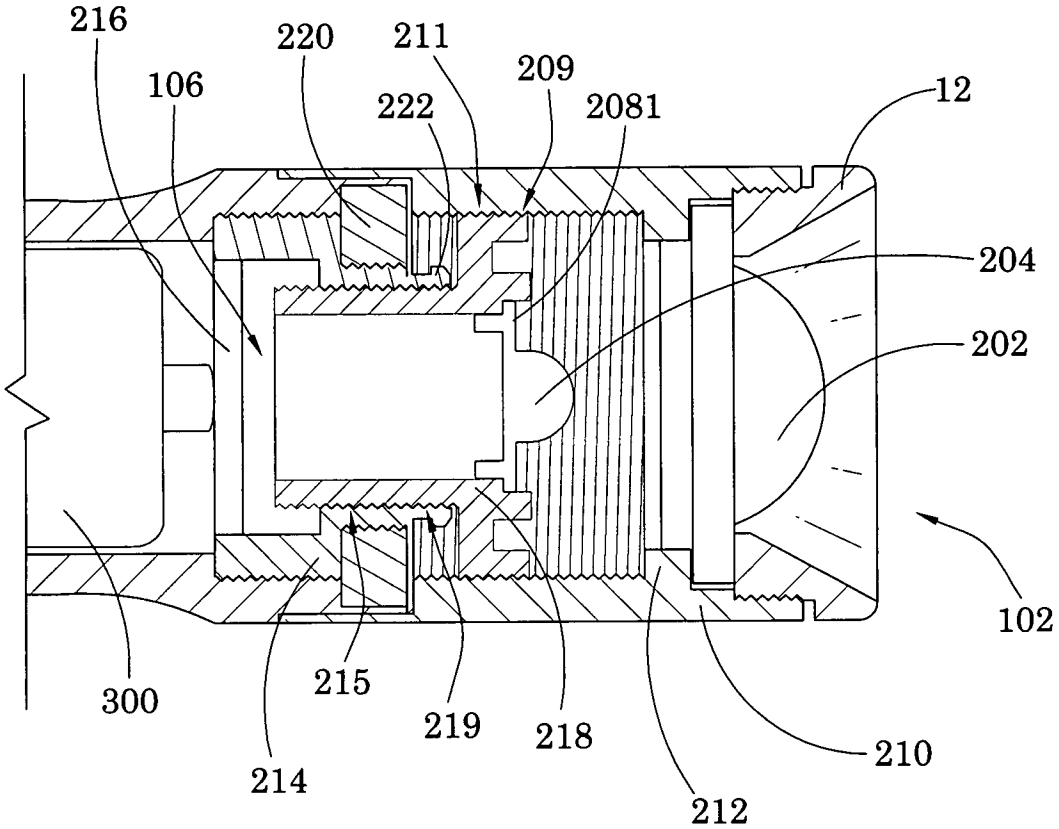
FIG. 4 is another partially sectional view of the flash light apparatus according to the preferred embodiment of the present invention, illustrating the light source being moved away from the lens.

As shown in FIGS. 2, 3 and 4, the light adjustor 206 comprises a light supporter 208, which is made of conductive material, disposed within the light cavity 106 for supporting the light source 204 and a sleeve actuator 210. The sleeve actuator 210, having a hollow structure, is rotatably and coaxially provided at an outer circumferential surface of the housing 100 at the light cavity 106 thereof.

The light supporter 208 further has a supporting platform 2081 operatively supporting the light source 204 thereat to coaxially align with the lens 202. Furthermore, the sleeve actuator 210 is arranged to drive the light supporter 208 to reciprocatingly move along the longitudinal axis of the housing 100, so as to adjust the distance between the light source 204 and the lens 202.

Accordingly, the illumination angle of the light beam generated from the light source 204 projecting through the lens 202 is able to be selectively adjusted through the longitudinal movement of the light supporter 208, which is supporting the light source 204 thereat, to move frontwardly and backwardly. In other words, a focus between the lens 202 and the light source 204 is adjustable via adjusting the distance therebetween through driving the light supporter 208 by the sleeve actuator 210, so as to adjust the illuminating angles of the light beam to select variety of light patterns, such as a narrower illuminating range as shown in FIG. 4 or a wider illuminating range as shown in FIG. 3.

As mentioned above, the light supporter 208 preferably has an outer threaded portion 209 and the sleeve actuator 210 preferably has an inner threaded portion 211 for engaging with the outer threaded portion 209 of the light supporter 208, so that when the sleeve actuator 210 is rotatably moved to drive the light supporter 208 moving reciprocatingly, the light source 204 is driven to reciprocatingly move toward and away from the lens 202, so as to generate variety of illuminating angles of the light beam. Therefore, through the inner threaded portion 211 of the sleeve actuator 210 driving the outer threaded portion 209 of the light supporter 208 of the light adjustor 206, the distance between the lens 202 and the light source 204 is adjustable without altering the fixed length L of the housing 100. It is worth mentioning that the sleeve actuator 210 is mounted at the housing 100 in a freely rotating manner such that when the sleeve actuator 201 is turned clockwise or counter clockwise with respect to the housing 100, the light source 204 is driven to reciprocatingly move toward and away from the lens 202.

In other words, the sleeve actuator 210 is rotatably moving only in radius direction to drive the light supporter 208 moving in both radius direction and the longitudinal axis direction of the housing 100 through the inner and outer threaded portion 209, 211 of the light supporter 208 and sleeve actuator 211 respectively, so as to adjust the illumination angles in the manner of fixed length L of the housing 100.

It will be readily appreciated by one skilled in the art that the sleeve actuator may also be engaging with the lens 202 or both of the lens 202 and the light supporter 208 supporting the light source 204 thereat for adjusting the distance between the lens 202 and the light source 204. It is worth to mention that the sleeve actuator 210 rotatably engaging with the light supporter 208 not only provides the adjustable illumination angles without altering the fixed length L of the housing 100, but also minimize the total fixed length L of the housing 100 while maximizing the range of variety of illumination angles.

It is worth to mention that the fixed length L of the housing 100 while adjusting the distance between the lens 202 and the light source 204 enables the flash light being stored into the original compartment or bag fittedly for receiving the flash light without adjusting to a minimized distance between the lens 202 and the light source 204, so that a user does not have to re-adjust the distance between the lens 202 and the light source 204 every time they take it out from the flash light bag or compartment.

In the present preferred embodiment, a front blocker 212 is preferably provided to dispose within the light cavity 106 at a rear side of the lens 202 to limit the light supporter 208 being moved forward to the lens 202, so as to prevent the lens 202 being hit by the light source 204. More particularly, the front blocker 212 is preferred to radially and inwardly protruded from a surrounding wall of the light cavity 106 at a front end of the inner threaded portion 211 of the sleeve actuator 210, so that when the light supporter 208 is driven to forwardly move toward the lens, the front blocker 212 is acting as a stopper to prevent the light supporter 208 moving forward to directly contact the light source 204, such as LED, with the lens 202, as best shown in FIG. 3.

In the presently preferred embodiment, the light arrangement 200 further comprises a tubular conductive holder 214 provided to electrically link the power source 300 with the light source 204 for providing electricity to the light source 204 to generate the light beam. The conductive holder 214, which is made of conductive material, is affixed within the power cavity 108 of the housing 100 to electrically contact with the light supporter 208 while contacting with the power source 300 via contacting to a terminal 216 preferably affixed to the conductive holder 214 within power cavity 108 of the housing 100, so as to ensure the light source 204 being electrically connected with the power source 300 when the light source 204 is moving.

Accordingly, the light supporter 208 further comprises a tubular conductor 218 extending rearwardly form a rear side of the light supporter 208 in the light cavity 106 toward the power cavity 108 of the housing 100. More particularly, the tubular conductor 218 is rearwardly extended from the supporting platform 2081 of the light supporter 208. The tubular conductor 218 is able to slidably contact with the tubular conductive holder 214 to ensure the light source 204 supported at the light supporter 208 is electrically connecting with the power source 300. In other words, the tubular conductor 218 extended from the rear side of the light supporter 208 has a predetermined length to ensure that the tubular conductor 218 is able to contact with the conductive holder 214 while the sleeve actuator 210 is being rotatably driven to drive the light supporter 208 moving reciprocatingly for adjusting the illumination angles of the light beam.

Specifically, when the light source 204 is reciprocatingly moved along the longitudinal axis of the housing 100, an outer circumferential surface of the tubular conductor 218 is slidably contacted with an inner circumferential surface of the conductive holder 214 to ensure light source 204 being electrically connected with the power source 300.

In order to ensure the conductive holder 214 and the tubular conductor 218 being slidably and stably contacted with each other, the conductive holder 214 may further has an inner threaded portion 215 formed at the inner circumferential surface thereof to engage with an outer threaded portion 219 of the tubular conductor 218 at the outer circumferential surface thereof, such that when the light supporter 208 is moving reciprocatingly, the tubular conductor 218 is guided to reciprocatingly slide to contact with the conductive holder 214 via the inner and outer threaded portions 215, 219 of the conductive holder 214 and tubular conductor 218 respectively.

It will be appreciated that the conductive holder 214 not only ensures the light supporter 208 being electrically conducted but also stably guides the light supporter 208 to reciprocatingly move along the longitudinal axis of the housing 100 via the threaded portion.

As will be appreciated by one skilled in the art, the inner and outer threaded portions 215, 219 of the conductive holder 214 and the tubular conductor 218 respectively may be interchangeable. In other words, the conductive holder 214 may be engaged with the tubular conductor 218 via an outer threaded portion of the conductive holder 214 engaging with an inner threaded portion of the tubular conductor 218.

Accordingly, a reinforcing ring 220 may be further provided for the conductive holder 214 reinforcing and stably guiding the tubular conductor 218 moving along the axis direction of the housing 100 to electrically connect with the power source 300. The reinforcing ring 200 is preferably affixed at the surrounding wall of the light cavity 106 at a position protruding inwardly and radially therefrom, wherein the reinforcing ring 220 is located between the surrounding wall of the light cavity 106 and the conductive holder 214, such that conductive holder 214 is being held stably in position for guiding the reciprocating movement of the tubular conductor 218, so as to keep contacting therewith.

As best shown in FIGS. 3 and 4, the conductive holder 214 further has a front blocking edge 222 located at a very front end of the conductive holder 214, so that when the light supporter 208 is driven to rearwardly move away from the lens, the front blocking edge 222 is able to limit the light supporter 208 being moved backwardly to the power cavity 108 of the housing 100.

According to the preferred embodiment, the housing 100 has a housing body 11 defining the power cavity 108 therewithin and a front cover 12 defining the front end 102 thereat. The lens 202 is sealed and affixed at the front cover 12 of the housing 100 for reinforcing the lens 202 being supported at the front end 102 of the housing 100.

In order to couple the front cover 12 with the housing body 11, the light arrangement 200 forms an adapter to coaxially link the front cover 12 with the housing body 11. As shown in FIG. 2, the conductive holder 214 is detachably and coaxially coupled at a front end of the housing body 11 while the sleeve actuator 211 is detachably and coaxially coupled with the front cover 12. Accordingly, the light supporter 208 is rotatably coupled within the sleeve actuator 211 in such a manner that when the tubular conductor 218 of the light supporter 208 is rotatably coupled with the conductive holder 214, the front cover 12 is coaxially aligned with the housing body 11. In other words, the light cavity 106 is defined within the sleeve actuator 211 at a position behind the front cover 12.

Therefore, when the light adjustor 206 is being rotatably moved to adjust the distance between the lens 202 and the light source 204, the fixed length L from the rear end 104 of the housing body 11 of the housing 100 to the front cover 12 is remaining the same. In other words, the housing 100 has the fixed length L while the distance between the lens 202 and the light source 204 is changing.

As shown in FIGS. 1 and 2 of the drawings, a switch 224 is further provided for controlling the power of the flash light preferably in an on-and-off manner, wherein the switch 224 is preferably provided at the closed rear end 104 of the housing 100 and electrically connecting with the power source 300 to controllably switching the power of the flash light. A rear cover 226 may further provided at the rear end 104 of the housing 100 to detachably seal the power cavity 108, so as for accessing the power source 300 within the power cavity 108.

As embodied in the present invention, the power source 300 is preferably one or more replaceable batteries being received within the power cavity 108 of the housing 100, so that the batteries are able to be accessed via removing the rear cover 226 to access the power cavity 108.

Accordingly, the switch 224 is preferably provided on the rear cover 226 for being conveniently controlling the switch 224 while holding a rear portion of the housing body 11 of the housing 100. Therefore, when the switch 224 is being pressed to electrically connect with the power source 300 to form a closed circuit between the light source 204, power source 300 and the switch 224, the light beam is generated from the light source 204. Likewise, when the switch 224 is being pressed again, the circuit is disconnected to turn off the power supplied to the light source 204 embodied as LED.

The front cover 12 reinforcing and retaining the lens 202 at the front end 102 of the housing 100 may be detachably coupling with the front end 102, such as via threaded portion at the peripheral edge of the front cover to engage threaded portion of the surrounding wall within the light cavity 106 to spirally or rotationally detach from or attach to the front end 102 of the housing 100, in such a manner that the structure of the light arrangement 200 can be easily assembled and disembled, so as to easily change the LED or light bulb of light source 204.

Thus, the structure of the conductive holder 214, tubular conductor 218, sleeve actuator 210, light supporter 208, light source 204, and the lens 202 of the light arrangement 200 can be simply assembled via the threaded portions and the detachable arrangements, so as to minimize the manufacturing cost.

The present invention not only can selectively adjust the illumination angles of the light beam without altering the fixed total length of the housing 100, but also provide a durable and stable electrical connection between the power source and the light source to prevent the happing of short-circuit.

Figure 5:
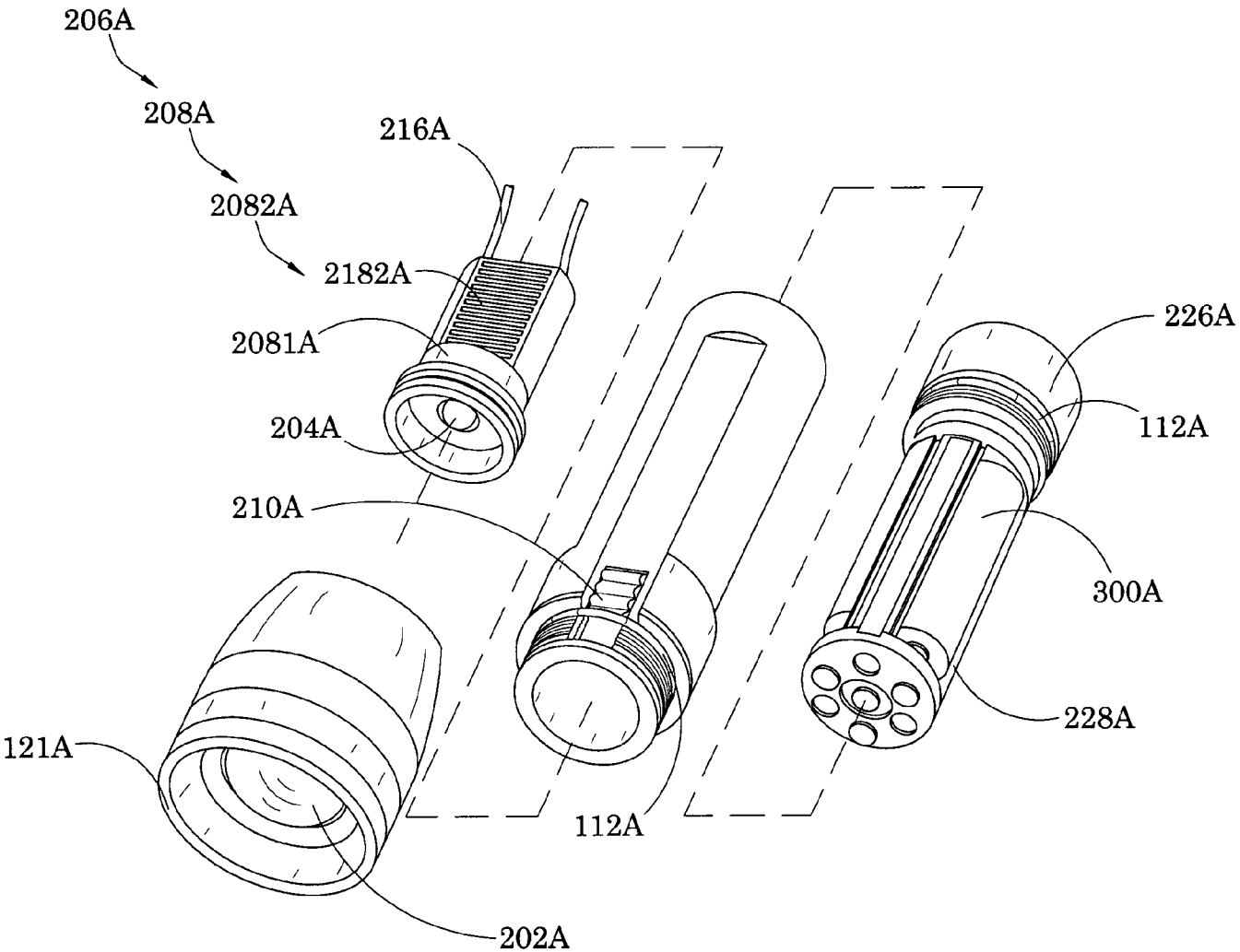
FIG. 5 is a perspective exploded view of a flash light apparatus according to a second preferred embodiment of the present invention.
Figure 6:
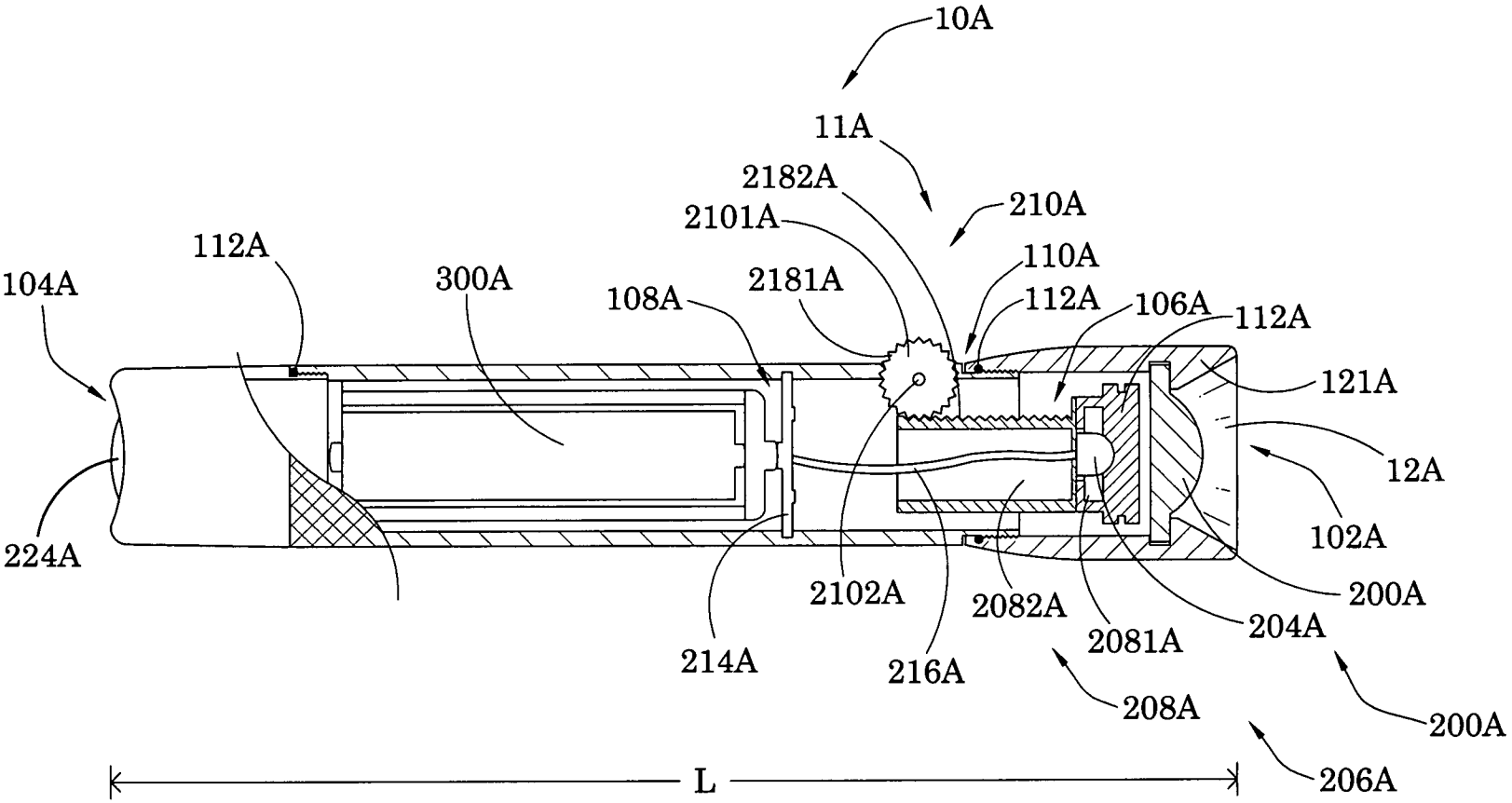
FIG. 6 is a side sectional view of the flash light apparatus according to the above second preferred embodiment of the present invention, illustrating the light source being moved at a forward position close to the lens.
Figure 7:
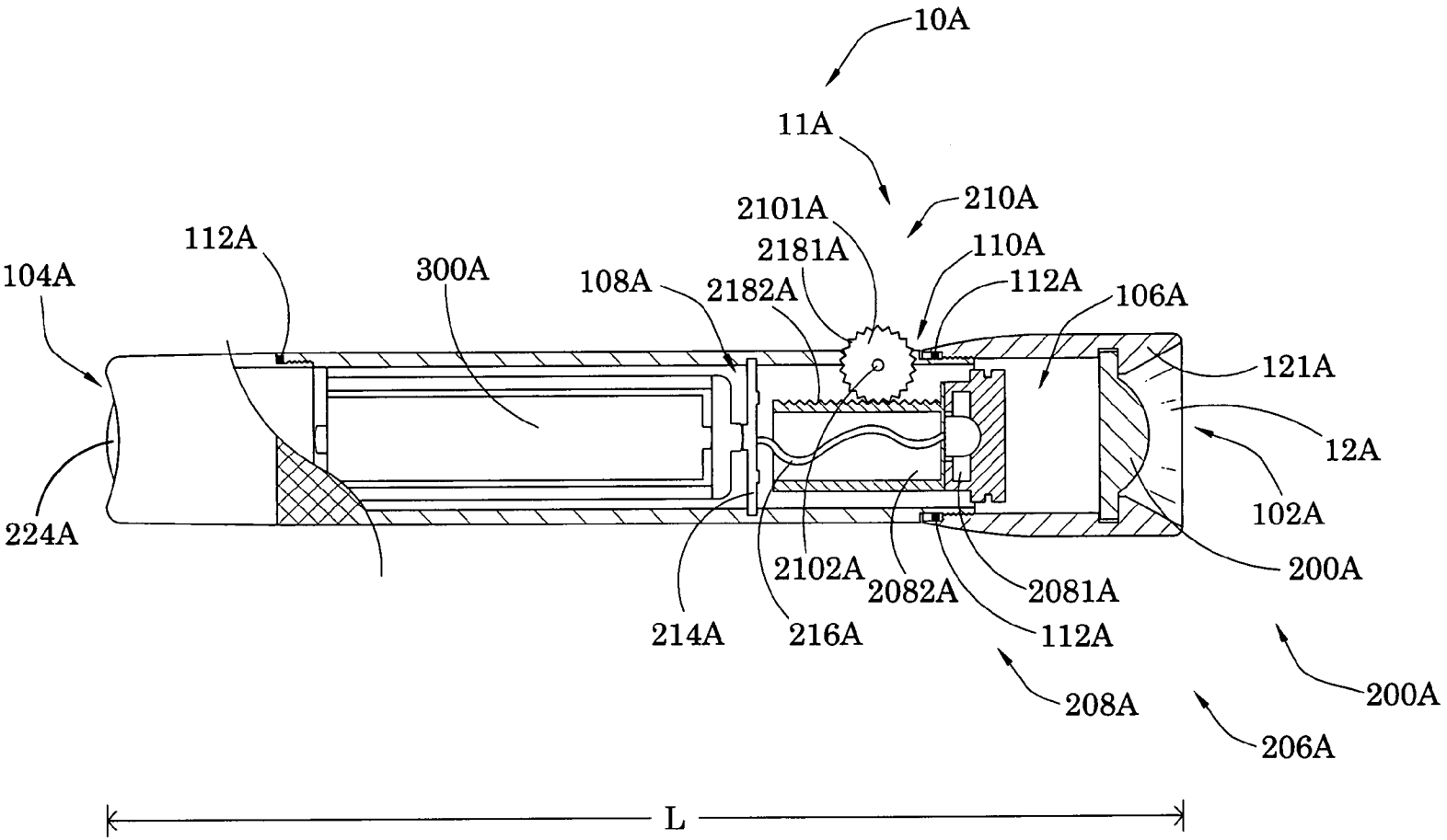
FIG. 7 is another side sectional view of the flash light apparatus according to the above second preferred embodiment of the present invention, illustrating the light source being moved away from the lens.

Referring to FIGS. 5 to 7 of the drawings, a flash light according to a second preferred embodiment of the present invention is illustrated, wherein the flash light comprises a hollow housing 100A and a light arrangement 200A.

The housing 100A has an open front end 102A and a closed rear end 104A to define a fixed length L between the front end 102A and the rear end 104A. The housing 100A further has a light cavity 106A formed at the front end 102A of the housing 100A and a power cavity 108A formed at the rear end 104A for receiving a power source 300A, which is electrically linked to the light arrangement 200A.

The light arrangement 200A comprises a lens 202A, a light source 204A disposed within the light cavity 106A, and a light adjustor 206A. The lens 202A is coaxially supported at the front end 102A of the housing 100A.

The light source 204A, preferably a LED, is disposed within the light cavity 106A within the light cavity 106A of the housing 100A for generating a light beam alignedly toward the lens 202A. The light adjustor 206A is movably coupling with the housing 100 to selectively adjust a distance between the light source 204A and the lens 202A along a longitudinal axis of the housing 100A for adjusting an illumination angle of the light beam without altering the fixed length L of the housing 100A.

According to second preferred embodiment of the present invention, the lens 202A of the light arrangement is preferably a resin convex lens to seal and affix at the front end 102A of the housing 100A, such that the convex lens 202A is able to provide a relatively wider range of the illumination angle to illuminate a larger area when the distance between the lens 202A and the light source 204A is minimized. The lens 202A may be made by the resin material to form a durable optical resin lens 202A with high light transmitting property. In addition, the lens 202A also forms a sealing cover sealed at the front end 102A of the housing 100A in a water-tight manner. It is worth to mention that the light source 204A is preferably LED due to the benefit of high intensity and low power requirement thereof. The light source 204A may also be a traditional light bulb or any other light sources which can be applied on the flash light.

As best shown in FIGS. 6 and 7, the light adjustor 206A comprises a light supporter 208A disposed within the light cavity 106A for supporting the light source 204A and an actuator 210A for controllably driving the light supporter 208A moving along the longitudinal axis of the housing 100A, so as to drive the light source 204A moving back and forth to adjust the distance between the light source 204A and the lens 202A. Furthermore, the actuator 210A is movably supported at a surrounding wall of the housing 100A to communicatively and partially dispose within the light cavity 106A, and is arranged to engage with the light supporter 208A for driving the light source 204A to reciprocatingly move along the longitudinal axis of the housing 100A in a slidable manner.

In other words, the actuator 210A will drive the light supporter 208A to reciprocatingly move along the longitudinal axis of the housing 100A via a longitudinal actuating force applied at the actuator 210A, so as to selectively adjust the distance between the light source 204A and the lens 202A. According to the preferred embodiment, a direction of the light source 204A being moved reciprocatingly is opposite to a direction of the longitudinal actuating force at the actuator 210A. Therefore, when the longitudinal actuating force is applied towards the front end 102A of the housing 100A, the light source 204A is moved away from the lens 202A to prolong the distance between the light source 204A and the lens 202A. When the longitudinal actuating force is applied towards the rear end 104A of the housing 100A, the light source 204A is moved towards the lens 202A to reduce the distance between the light source 204A and the lens 202A.

Accordingly, the light supporter 208A comprises a light reflective platform 2081A operatively supporting the light source 204A thereat to coaxially align with the lens 202A, and an actuating platform 2082A rearwardly extending from the light reflective platform 2081A.

The light reflective platform 2081A has an indented light reflective surface, wherein the light source 204A is supported at the center of the light reflective surface such that the light reflective surface is adapted to effectively reflect the light from the light source 204A towards the lens 202A so as to enhance the light intensity of the flash light.

Accordingly, the actuating platform 2082A is preferably to be slidably located within the light cavity 106A. Therefore, the actuator 210A is engaging with the actuating platform 2082A for driving the light supporter 208A to move frontwardly and backwardly along the longitudinal axis of the housing 100A. In other words, the actuator 210A is preferably provided for being actuated to generate the reciprocatingly sliding movement of the light supporter 208A along the longitudinal axis of the housing 100A.

In the second preferred embodiment of the present invention, the actuating platform 2082A is preferably engaging with the actuator 210A in a meshing manner for minimizing the size of the actuator 210A and maximizing an adjustable distance between the light source 204A and the lens 202A.

The actuator 210A comprises an actuating rotor 2101A rotatably supported at a surrounding wall of the housing 100A to define a manipulating portion protruded above the surrounding wall of the housing 100A and a driving portion positioned below the surrounding wall of the housing 100A to engage with the actuating platform 2082A of the light supporter 208A, in such a manner that when the manipulating portion of the actuating rotor 2101A is rotated back and forth via the longitudinal actuating force, the light supporter 208A is driven to reciprocatingly move along the longitudinal axis of the housing 100A.

In addition, the light adjustor 206A comprises a plurality of first gear teeth 2181A evenly formed at a circumferential surface of the actuating rotor 2101A, and a plurality of second gear teeth 2182A evenly formed at the actuating platform 2082A to selectively engage with the first gear teeth 2181A.

In other words, when the first gear teeth 2181A are meshed with the second gear teeth 2182A, the actuator 210A is able to be driven to rotate for controllably driving the light supporter 208A to move along the longitudinal axis of housing 100A frontwardly and backwardly in the slidable manner.

As will be readily appreciated by one skilled in the art, the actuator 210A may be engaging with the actuating platform 2802A of the light supporter 208A in an interlocking manner or the likes, so that the light source 204A is able to slidably move frontwardly and backwardly along the longitudinal axis of the housing 100A by applying the longitudinal actuating force on the actuator 210A to actuate the sliding movement of the light supporter 208A, so as to adjust the distance between the light source 204A and the lens 202A without alternating the total length L of the housing 100A. However, the meshing engagement between the actuator 210A and the light supporter 208A, as mentioned in the second preferred embodiment of the present invention, is able to efficiently apply the longitudinal actuating force at the actuator 210A for reciprocatingly slidably moving the light source 204A towards or away from the lens 202A so as to adjust the angle of the light projected through the lens 202.

In particularly, a front portion of the light supporter 208A forms the light reflective platform 2081A thereat while a rear portion of the light supporter 208A forms the actuating platform 2802A thereat. Accordingly, the rear portion of the light supporter 208A has an essentially elongated tubular shape longitudinally extending from the front portion of the light supporter 208A. The actuating platform 2802A is a flat surface formed at the rear portion of the light supporter 208A, wherein the driving portion of the actuating rotor 2101A is tangentially engaged with the actuating platform 2802A.

The flat actuating platform 2802A formed at the rear portion of the supporter 208A not only enables the second gear teeth 2182A evenly formed at the actuating platform 2082A but also provides an adequate space between the surrounding wall of the housing 100A and the actuating platform 2082A of the light supporter 208. Therefore, the driving portion of the actuating rotor 2101A can disposed within the light cavity 106A at a position below the surrounding wall of the housing 100A to engage with the actuating platform 2082A for selectively adjusting the distance between the light source 204A and the lens 202A.

According to the second preferred embodiment of the present invention, the second gear teeth 2182A are evenly formed at the flat actuating platform 2082A with even teething space. In other words, a through slot 110A is preferably provided at the surrounding wall of the housing 100A to communicating with the light cavity 106A, wherein the actuating rotor 2101A of the actuator 210A is rotatably coupling with the housing 100A at the through slot 110A thereof, such that the first gear teeth 2181A of the actuator 210A is rotatably meshing with the second gear teeth 2182A of the actuating platform 2082A for driving the light supporter 208A reciprocatingly moving along the longitudinal axis of the housing 100A. In other words, the light source 204A is driven to reciprocatingly move toward and away from the lens 202A with responsive to the actuator 210A, so as to generate variety of illuminating angles of the light beam.

More specifically, the actuating platform 2082A preferably has an elongated rectangular shape horizontally extending within the light cavity 106A for moving along the longitudinal axis of housing 100A, wherein the second gear teeth 2182A are preferred to parallelly extend on the actuating platform 2082A. A rotational shaft 2102A may further be provided to vertically and fixedly extend at the through slot 110A. The actuating rotor 2101A of the actuator 210A is preferred to rotatably and fixedly couple with the rotational shaft 2102A to fittingly couple at the through slot 110A to engage with the actuating platform 2082A. The first gear teeth 2181A are preferred to parallelly extended along the circumferential surface at a circular shaped surrounding wall surface of the actuating rotor 2102A of the actuator 210A to mesh with the spacedly and vertically extended second gear teeth 2182A at the actuating platform 2082A, in such a manner that the actuator 210A is able to be horizontally and rotatably actuated to drive the light supporter 208A reciprocatingly moving forward and backward along the longitudinal axis of the housing 100A in responsive to the actuator 210A.

It will be appreciated that the elongated tubular shape of the rear portion of the light supporter 208A preferably having a cross section essentially matching size and shape of a cross section of the housing 100A and the actuating platform 2082A meshing with the second gear teeth 2182A ensures the light supporter 208A stably guiding the light supporter 208A to reciprocatingly move along the longitudinal axis of the housing 100A.

As will be readily appreciated by one skill in the art, the first gear teeth 2181A can also be horizontally and non-parallelly extending along the outer circumferential surface of the circular shaped surrounding wall of the actuating rotor 2101A. For example, the first gear teeth 2181A may be continuously extending at the outer circumferential surface of the actuator to meshing with an outer threaded portion of the light supporter 208A, so that the actuator 210A is able to be vertically rotated to push the light supporter 208A. It is worth to mention that the parallelly and spacedly extended first gear teeth 2181A meshing the parallelly extended second gear teeth 2182A are able to minimize the size of the actuator 210A while maximizing the adjustable distance between the light source 204A and the lens 202A, so as to efficiently apply minimum pushing force to rotatably actuate the actuator 210A.

Accordingly, the illumination angle of the light beam generated from the light source 204A projecting through the lens 202A is able to be selectively adjusted through the longitudinal movement of the light supporter 208A, which is supporting the light source 204A thereat, to move frontwardly and backwardly. In other words, a focus between the lens 202A and the light source 204A is adjustable via adjusting the distance therebetween through driving the light supporter 208A by the actuator 210A, so as to adjust the illuminating angles of the light beam to select variety of light patterns, such as a narrower illuminating range with greater light intensity as shown in FIG. 7 or a wider illuminating range as shown in FIG. 6.

Therefore, through the engagement between the actuator 210A and the light supporter 208A, the distance between the lens 202A and the light source 204A is adjustable without altering the fixed length L of the housing 100A. It is worth mentioning that the actuator 210A is rotatably mounted at the housing 100A via the rotational shaft 2102A in a freely rotating manner such that when the actuator 210A is rotated frontwardly or backwardly with respect to the housing 100A, the light source 204A is driven to reciprocatingly move toward and away from the lens 202A, so as to adjust the illumination angles in the manner of fixed length of the housing 100A.

In other words, the actuator 210A is rotatably moving only the longitudinal axis direction to drive the light supporter 208A moving in the longitudinal axis direction of the housing 100A through the first and second gear teeth 2181A, 2182A at the actuator 210A and the light supporter 208A respectively. Thus, the actuator 210A is able to be rotatably actuated via one thumb of a user, for example, in a one hand operable manner.

It is worth to mention that the fixed length L of the housing 100A while adjusting the distance between the lens 202A and the light source 204A enables the flash light being stored into the original compartment or bag fittedly for receiving the flash light without adjusting to a minimized distance between the lens 202A and the light source 204A, so that a user does not have to re-adjust the distance between the lens 202A and the light source 204A every time they take it out from the flash light bag or compartment.

According to the second preferred embodiment of the present invention, the housing 100A further comprises two spaced apart blocking rims 112A inwardly protruded from an inner wall of the housing 100A within the light cavity 106A to limit the traveling distance of the light reflective platform 2081A within the light cavity 106A along the longitudinal axis. The blocking rims 112A are front and rear blocking rims 112A.

Accordingly, the light reflective platform 2081A has a protruding rim 212A protruding outwardly, wherein when the light supporter 208A is moved forward, the protruding rim 212A is blocked by the front blocking rim 112A for preventing any further forward movement of the light source 204A. Therefore, the protruding rim 212A is adapted for limiting the light supporter 208A being moved toward the lens 202A, so as to prevent the lens 202A being hit by the light source 204A. In other words, when the light supporter 208A is driven to move forwardly in responsive to the actuator 210A, the front blocking rim 112A acts as a front stopper to prevent the light source 204A, preferably LED light, directly contacting with the lens 202A to damage the light source 204A, as best shown in FIG. 6 of the drawings. Likewise, when the light supporter 208A is driven to move rearwardly in responsive to the actuator 210A, the rear blocking rim 112A acts as a rear stopper to prevent the light source 204A entering into the power cavity 108A of the housing 100A.

The light arrangement may further comprises a control circuit 214A coaxially affixed within the housing 100A to define the light cavity 106A between the control circuit 214A and the front end 102A of the housing 100A, and the power cavity 108A between the control circuit 214A and the rear end 104A of the housing 100A, wherein the control circuit 214A is preferably circular shaped in accordance with a circular cross section of a preferred essentially elongated tubular shaped housing 100A. The control circuit 214A is arranged to electrically connect the power source 300A within the power cavity 108A to the light source 204A.

In order to ensure the light source 204A is electrically connecting to the power source 300A at all time, a flexible electrical cable electrically extended from the light source 204A and the power source 300A, wherein a length of the electrical cable is longer than a longitudinal traveling distance of the light source 204A.

Accordingly, the electrical cable comprises at least two conducting wires 216A having a predetermined flexibility are preferably provided to extend from the light source 204A to electrically connect to control circuit 214A, so as to form a loop of the light source 204A and the power source 300A to electrically connect with each other. The conducting wires 216A have a predetermined length movably extending from the light source 204A to the control circuit 214A, so that when the actuator 210A is movably and rotatably drive the light supporter 208A to longitudinally and reciprocatingly sliding within the light cavity 106A, the conducting wires 216A are able to be flexibly stretched or bent to ensure the light source 204A to electrically connect to the power source 300A at all time.

It is worth mentioning that the conducting wires 216A are extended from the light source 204A to the control circuit 214A through the light supporter 208A. In particularly, the light supporter 208A has two longitudinal guiding channels for the conducting wires 216A extending therethrough respectively, so as to prevent the conducting wires 216 being tangled with each other during the sliding movement of the light supporter 208A.

According to the preferred embodiment, the housing 100A has a housing body 11A defining the power cavity 108A therewithin and a front cover 12A defining the front end 102A thereat. The front cover 12A further has a front opening frame 121A at the open front end 102A, wherein the lens 202A is sealed and affixed at the front opening frame 121A of the front cover 12A for coaxially reinforcing the lens 202A being supported at the front end 102A of the housing 100A.

In order to couple the front cover 12A with the housing body 11A, an inner threaded portion adjacent to a rear portion of inner surround surface of the front cover 12A, for example, is preferably formed for coaxially and rotatably coupling with an outer threaded portion adjacent to front surrounding wall of the housing body 11A. Accordingly, the front cover 12A is detachably rotatably coupled with the housing body 11A, in such a manner that the front opening frame 121A of the front cover 12A is coaxially aligned with the housing body 11A to align the light source 204A with the lens 202A. In other words, the light cavity 106A is partially within the front cover 12A at a position behind the front opening frame 121A.

Therefore, when the light adjustor 206A is being rotatably pushed to adjust the distance between the lens 202A and the light source 204A, the fixed length L from the rear end 104A of the housing body 11A of the housing 100A to the front opening frame 121A is remaining the same. In other words, the housing 100A has the fixed length L while the distance between the lens 202A and the light source 204A is changing.

As shown in FIGS. 5 to 7 of the drawings, a switch 224A is further provided for controlling the power of the flash light preferably in an on-and-off manner, wherein the switch 224A is preferably provided at the rear end 104A of the housing 100A and electrically connecting with the power source 300A to electrically connect to the circuit board at the control circuit 214A, so as for controllably switching the power of the flash light. A rear cover 226A may further provided at the rear end 104A of the housing 100A to detachably seal the power cavity 108A, so as for accessing the power source 300A within the power cavity 108A.

It is worth to mention that a power source holder 228A may further integrally and frontwardly extending from the rear cover 226A to electrically connect the power source with the switch 224A, so as to electrically connect to the light source 204A via the conductive plat 214A. The power source holder 228A integrally formed with the rear cover 226A enables the power source 300A, such as plurality of batteries, being easily accessed for removing or replacing the power source 300A within the power cavity 108A. Therefore, as embodied in the present invention, the power source 300A is preferably one or more replaceable batteries being received by the movable power source holder 228A, so that the batteries are able to be accessed via removing the rear cover 226A to access the power cavity 108A.

Accordingly, the switch 224A is preferably provided on the rear cover 226A for being conveniently controlling the switch 224A while holding a rear portion of the housing body 11A of the housing 100A. Therefore, when the switch 224A is being pressed to electrically connect with the power source 300A to form a closed circuit between the light source 204A, power source 300A and the switch 224A, the light beam is generated from the light source 204A. Likewise, when the switch 224A is being pressed again, the circuit is disconnected to turn off the power supplied to the light source 204A embodied as LED.

The front cover 12A reinforcing and retaining the lens 202A at the front end 102A of the housing 100A can be detachably coupling with the housing body 11A, such as above mentioned via threaded portions of the rear portion of front cover 12A and the front portion of the housing body 11A to spirally or rotationally detach from or attach to the housing body 11A, in such a manner that the structure of the light arrangement 200A is able to be easily assembled and dissembled, so as to easily change the LED or light bulb of light source 204A.

Therefore, the actuator 210A and the light supporter 208A can be simply assembled via the gear engagement, so that it not only simplifies the overall structure of the flash light, but also minimizes the amount of assembling parts to further cost down of spend of manufacture.

At least two sealing rings may further provided between the front cover 12A and the housing body 11A, and between the rear cover 12A and the housing body 11A. Therefore, the two sealing rings and the fixed lens 202A fixedly located at the front opening frame 121A of the front cover 12A are able to effectively enhance the waterproof functionality of the flash light.

The present invention not only can selectively adjust the illumination angles of the light beam without altering the fixed total length of the housing 100A, but also provide an simple operating method for driving the light supporter 208A reciprocatingly moving forward and backward along the longitudinal axis of the housing 100A, so as to allow the user to actuate the actuator 210A in the one hand operable manner.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flash light, comprising:

a hollow housing having a front end, a rear end to define a fixed length between said front end and said rear end, and a light cavity formed within said front end, wherein said housing further comprises two spaced apart blocking rims inwardly protruded from an inner wall of said housing within said light cavity thereof; and a light arrangement, which comprises:

a convex lens affixed at said open front end of said housing for providing wider range of illumination angle;

a light source, which is a LED light source, disposed within said light cavity for generating a light beam alignedly towards said lens; and a light adjustor movably coupling with said housing wherein said light source is moved along said longitudinal axis of said housing by said light adjustor to selectively adjust a distance between said light source and said lens for adjusting the illumination angle of said light beam without altering said affixed length of said housing, wherein said light adjustor comprises a light reflective platform slidably supported within said light cavity, wherein said light source is coupled at a center of said light reflective platform to coaxially align with said lens, such that when said light adjustor is actuated to move said light source, said light reflective platform of said light adjustor is correspondingly moved for enhancing a light intensity of said light source toward said lens, wherein a traveling distance of said reflective platform is limited between said blocking rims.

2. The flash light, as recited in claim 1, wherein said lens is fixed at said front end of said housing, wherein said lens is also sealed at said open front end of said housing in a watertight manner to form a sealing cover thereat.

3. The flash light, as recited in claim 1, wherein said light adjustor comprises a light supporter slidably disposed within said light cavity to support said light source in a slidably movable manner, and an actuator driving said light supporter to reciprocatingly move along said longitudinal axis of said housing via a longitudinal actuating force applied at said actuator, so as to selectively adjust the distance between said light source and said lens.

4. The flash light, as recited in claim 2, wherein said light adjustor comprises a light supporter slidably disposed within said light cavity to support said light source in a slidably movable manner, and an actuator driving said light supporter to reciprocatingly move along said longitudinal axis of said housing via a longitudinal actuating force applied at said actuator, so as to selectively adjust the distance between said light source and said lens.

5. The flash light, as recited in claim 3, wherein said actuator comprises a an actuating rotor rotatably supported at a surrounding wall of said housing to define a manipulating portion protruded above said surrounding wall of said housing and a driving portion positioned below said surrounding wall to engage with said light supporter, in such a manner that when said manipulating portion of said actuating rotor is rotated back and forth via said longitudinal actuating force, said light supporter is driven to reciprocatingly move along said longitudinal axis of said housing.

6. The flash light, as recited in claim 4, wherein said actuator comprises a an actuating rotor rotatably supported at a surrounding wall of said housing to define a manipulating portion protruded above said surrounding wall of said housing and a driving portion positioned below said surrounding wall to engage with said light supporter, in such a manner that when said manipulating portion of said actuating rotor is rotated back and forth via said longitudinal actuating force, said light supporter is driven to reciprocatingly move along said longitudinal axis of said housing.

7. The flash light, as recited in claim 5, wherein said light supporter further has an actuating platform rearwardly extended from said light reflective platform to engage with said driving portion of said actuating rotor, such that when said actuating platform is driven to move longitudinally, said light reflective platform and said light source are longitudinally moved correspondingly.

8. The flash light, as recited in claim 6, wherein said light supporter further has an actuating platform rearwardly extended from said light reflective platform to engage with said driving portion of said actuating rotor, such that when said actuating platform is driven to move longitudinally, said light reflective platform and said light source are longitudinally moved correspondingly.

9. The flash light, as recited in claim 7, wherein said light adjustor further comprises a plurality of first gear teeth evenly formed at a circumferential surface of said actuating rotor, and a plurality of second gear teeth evenly formed at said actuating platform to selectively engage with said first gear teeth.

10. The flash light, as recited in claim 8, wherein said light adjustor further comprises a plurality of first gear teeth evenly formed at a circumferential surface of said actuating rotor, and a plurality of second gear teeth evenly formed at said actuating platform to selectively engage with said first gear teeth.

11. The flash light, as recited in claim 8, wherein said actuating platform is a flat surface that said driving portion of said actuating rotor is tangentially engaged with said actuating platform.

12. The flash light, as recited in claim 10, wherein said actuating platform is a flat surface that said driving portion of said actuating rotor is tangentially engaged with said actuating platform.

13. The flash light, as recited in claim 4, wherein a direction of said light source being moved reciprocatingly is opposite to a direction of said longitudinal actuating force such that when said longitudinal actuating force is applied towards said front end of said housing, said light source is moved away from said lens, and when said longitudinal actuating force is applied towards said rear end of said housing, said light source is moved towards said lens.

14. The flash light, as recited in claim 12, wherein a direction of said light source being moved reciprocatingly is opposite to a direction of said longitudinal actuating force such that when said longitudinal actuating force is applied towards said front end of said housing, said light source is moved away from said lens, and when said longitudinal actuating force is applied towards said rear end of said housing, said light source is moved towards said lens.

15. A flash light, comprising:

a hollow housing having a front end, a rear end to define a fixed length between said front end and said rear end, a light cavity formed within said front end, and a power cavity formed adjacent to said rear end for receiving a power source within said power cavity, wherein said housing further comprises two spaced apart blocking rims inwardly protruded from an inner wall of said housing within said light cavity thereof; and a light arrangement, which comprises:

a convex lens fixed at said front end of said housing;

a light source, which is a LED light source, disposed within said light cavity for electrically linking with said power source to generate a light beam alignedly towards said lens; and a light adjustor, which comprises:

a light supporter comprising a light reflective platform operatively supporting said light source thereat to coaxially align with said lens and slidably supported within said light cavity, and an actuating platform rearwardly extended from said light reflective platform; and an actuating rotor rotatably supported at a surrounding wall of said housing to define a manipulating portion protruded above said surrounding wall of said housing and a driving portion positioned below said surrounding wall to engage with said actuating platform, wherein when said manipulating portion of said actuating rotor is rotated back and forth, said light reflective platform of said light supporter is driven to reciprocatingly move within said light cavity to selectively adjust a distance between said light source and said lens along a longitudinal axis of said housing for adjusting an illumination angle of said light beam without altering said affixed length of said housing, wherein a traveling distance of said reflective platform is limited between said blocking rims.

16. The flash light, as recited in claim 15, wherein said light arrangement further comprises at least a flexible electrical cable electrically extended from said light source and said power source, wherein a length of said electrical cable is longer than a longitudinal traveling distance of said light source.

17. The flash light, as recited in claim 16, wherein said light adjustor further comprises a plurality of first gear teeth evenly formed at a circumferential surface of said actuating rotor, and a plurality of second gear teeth evenly formed at said actuating platform to selectively engage with said first gear teeth.

18. The flash light, as recited in claim 17, wherein said actuating platform is a flat surface that said driving portion of said actuating rotor is tangentially engaged with said actuating platform.

* * * * *